US006378435B1

(12) United States Patent
Bai et al.

(10) Patent No.: US 6,378,435 B1
(45) Date of Patent: Apr. 30, 2002

(54) VARIABLE TARGET TRANSITION DETECTION CAPABILITY AND METHOD THEREFOR

(75) Inventors: Monty W. Bai, Scottsdale; Gerald James Moore; Ralph Eugene Foresman, both of Mesa, all of AZ (US)

(73) Assignee: General Dynamics Decision Systems, Inc., Scottsdale, AZ (US)

( * ) Notice: Subject to any disclaimer, the term of this patent is extended or adjusted under 35 U.S.C. 154(b) by 0 days.

(21) Appl. No.: 08/415,973

(22) Filed: Apr. 3, 1995

(51) Int. Cl.[7] ..... F23Q 21/00

(52) U.S. Cl. ..... 102/215; 102/206; 102/211; 102/221; 102/397; 102/501; 89/1.11

(58) Field of Search ..... 102/211, 215, 102/216, 221, 382, 396, 397, 499, 500, 501, 206; 114/20.1, 20.2; 244/3.11, 3.15; 89/1.11

(56) References Cited

U.S. PATENT DOCUMENTS

| | | | | | |
|---|---|---|---|---|---|
| 2,489,255 | A | * | 11/1949 | Barker | 102/499 |
| 3,633,510 | A | * | 1/1972 | Bernardin | 102/211 |
| 3,737,122 | A | * | 6/1973 | Solov et al. | 244/3.21 |
| 3,853,065 | A | * | 12/1974 | Apstein | 102/397 |
| 4,019,440 | A | * | 4/1977 | Strike | 102/397 |
| 4,217,827 | A | * | 8/1980 | Dent | 102/215 |
| 4,640,194 | A | * | 2/1987 | Witt et al. | 102/397 |
| 4,750,689 | A | * | 6/1988 | Yff | 244/3.21 |
| 4,773,328 | A | * | 9/1988 | Germershausen et al. | 102/211 |
| 4,979,696 | A | * | 12/1990 | Yff | 244/3.21 |
| 5,317,914 | A | * | 6/1994 | Franco, Jr. | 73/167 |
| 5,381,445 | A | * | 1/1995 | Hershey et al. | 102/501 |
| 5,432,546 | A | * | 7/1995 | Cargill | 244/3.11 |

FOREIGN PATENT DOCUMENTS

| | | | | |
|---|---|---|---|---|
| DE | 3403349 | * | 8/1985 | 102/221 |

* cited by examiner

*Primary Examiner*—Michael J. Carone
*Assistant Examiner*—Theresa Wesson
(74) *Attorney, Agent, or Firm*—Jenner & Block, LLC

(57) ABSTRACT

A projectile fuze detects transitions between target layers by an electronic antenna radiating laterally into the target material and coupled to a pullable oscillator whose frequency shifts as the target material changes while the projectile penetrates. A frequency shift threshold detector relates the observed frequency shifts to a stored target profile to detonate the projectile after the desired layer penetration.

9 Claims, 4 Drawing Sheets

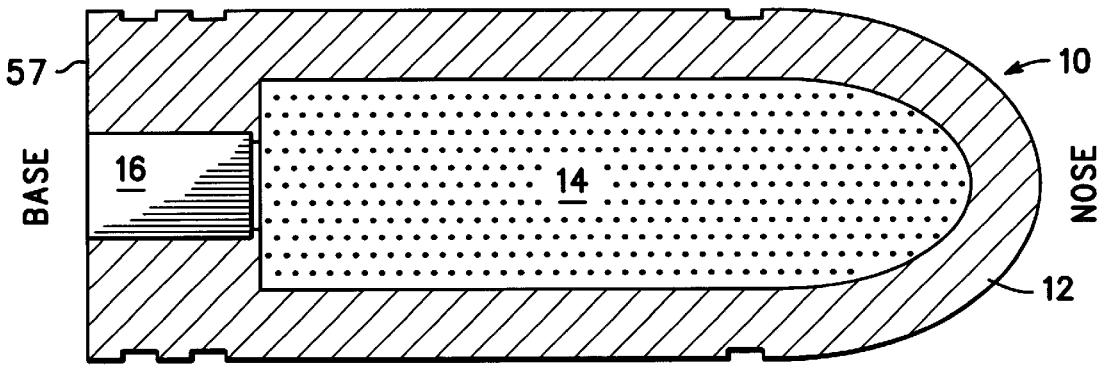
FIG. 1 - PRIOR ART -
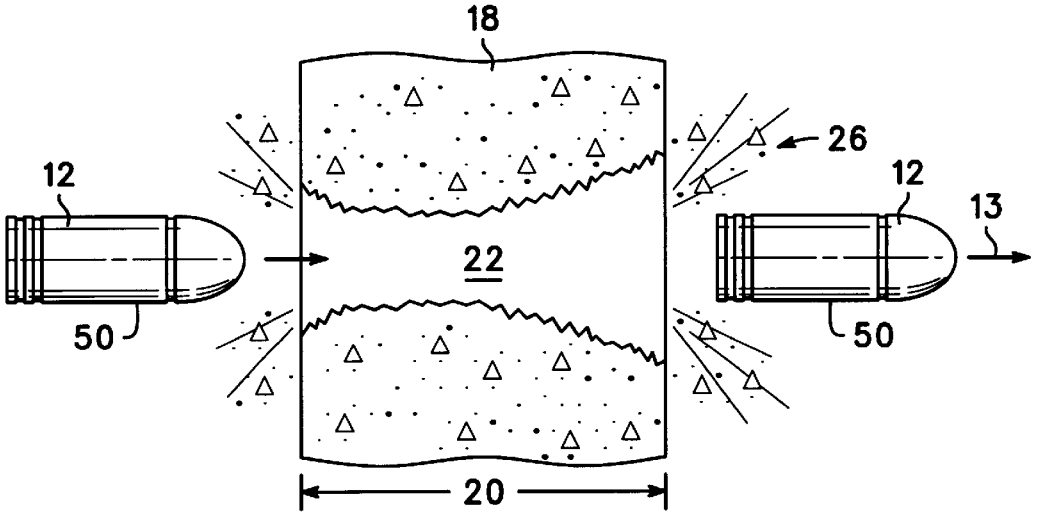
FIG. 2
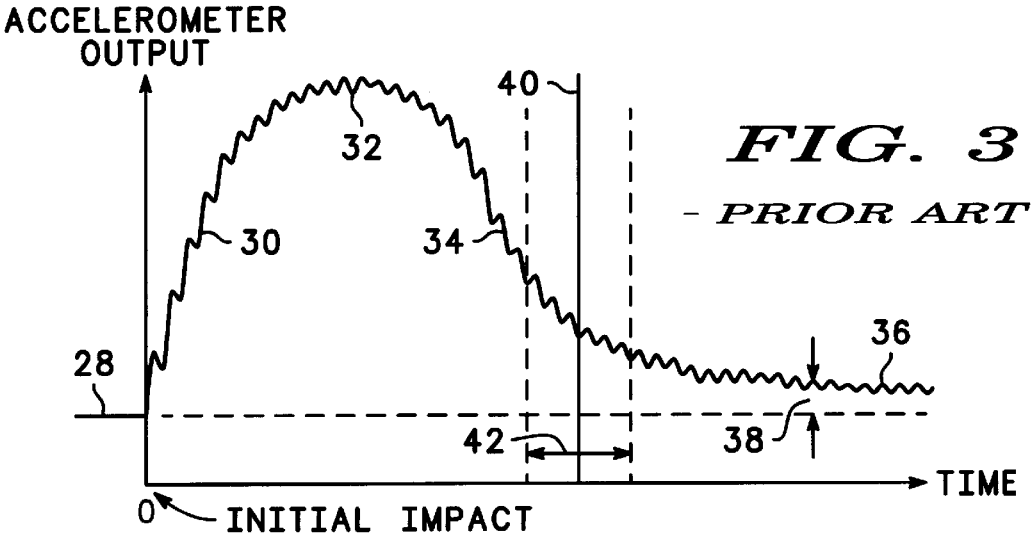
FIG. 3
- PRIOR ART -

VARIABLE TARGET TRANSITION DETECTION CAPABILITY AND METHOD THEREFOR

FIELD OF THE INVENTION

This invention concerns means and methods for fuzing weapon projectiles, and more particularly, an improved projectile and fuzing system capable of detecting penetration of the projectile through various target layers of different properties.

BACKGROUND OF THE INVENTION

It is well known in the art of weaponry to provide projectiles, as for example, artillery shells, mortar shells, rockets, bombs and other devices, with sensors or fuzes that detect target proximity or impact. The effectiveness of such projectiles can be dramatically improved if the fuzing system of the projectile is able to recognize the target in terms of its materials, thicknesses and numbers of layers, including voids. It is desirable to be able to program the projectile fuze to assess the materials and structure of the target as it penetrates so that the optimum delay and detonation time may be determined.

Proximity fuzes are extremely useful in determining when the projectile is approaching or about to strike a target. Where the fuzing strategy calls for the weapon to be detonated prior to impact, proximity detectors are extremely useful.

Where the fuzing strategy calls for the weapon projectile to be detonated on impact or a predetermined time after impact, accelerometers and timers (typically mounted in the base of the projectile) are frequently used to control detonation.

FIG. 1 shows a typical prior art projectile 10 having casing 12 powder charge 14 and base mounted accelerometer triggered fuze 16. FIG. 2. illustrates what happens when projectile 12 moving along path 13 strikes concrete wall 18 of thickness 20, thereby causing hole 22 to be created therein. In general, a large amount of debris 26 is ejected from wall 18 as projectile 12 exits.

FIG. 3 shows a typical accelerometer output as a function of time. Prior to impact, that is, prior to time T=0, accelerometer 16 has initial offset 28. As projectile strikes concrete wall 18, there is a rapid rise in accelerometer output as indicated by curve 30 to a maximum at 32 followed by a more gradual falloff at 34 to a further quiescent level 36 after projectile 12 has exited wall 18.

In general, further quiescent level 36 is offset from initial level 18 by amount 38.

Vertical line 40 in FIG. 3 indicates the theoretical time required for projectile 12 to exit wall 18. It is often desired to use the output of accelerometer 16 to determine the exit time. However, as indicated by region 42 in FIG. 3, the time at which exit has occurred is difficult to accurately determine because of the lack of a sharp falloff transition in the accelerometer output and the large amounts of electrical noise that typically accompany such events. Thus, the inability to determine with precision and reliability the precise time at which a projectile makes a transition from one region of the target, (e.g. from a concrete layer into a further region of the target, as for example, a void or earthen layer) substantially interferes with efficient device fuzing. For example, in weapons designed to disrupt runways, it is extremely important to detonate the projectile after it has passed through the runway into the underlying gravel or other foundation layer and before it has penetrated deeply into the earth. When this is done correctly, a relatively small projectile is capable of producing a very large crater. If detonation is too early or too late, the extent of damage to the runway surface may be minor. Fixed timing intervals are unsatisfactory because they fail to accommodate varying initial layer thicknesses of a runway, bunker or other structure. A further problem with conventional prior art accelerometer-type fuzes is that they are highly susceptible to the very large shock waves which propagate or "ring" back and forth from one end of the projectile to the other during the course of target penetration.

Accordingly, a continuing need exists for more accurate means and methods for determining when projectiles or probes go from one layer to another layer in a target so that different layers can be detected and, in the case of explosive projectiles, fuze detonation time delay accurately set. This need is especially important in connection with fuzes which are desired to penetrate through multiple target layers prior to detonation.

It is an advantage of the present invention that there is provided an improved means and method for detecting when a projectile is making a transition between target layers of different material properties. It is a further advantage of the present invention that one or more sensors are provided with the projectile whose output varies according to the nature of the material through which the projectile is penetrating.

BRIEF DESCRIPTION OF THE DRAWINGS

FIG. 1 is a simplified side cross-sectional and partial cutaway view of a projectile according to the prior art;

FIG. 2 is a simplified cross-sectional and cutaway view showing the penetration of a projectile through a first target layer;

FIG. 3 is a simplified plot of an accelerometer sensor output versus time according to the prior art during penetration of a comparatively hard target by a conventional accelerometer fuzed projectile of the prior art;

DETAILED DESCRIPTION OF THE DRAWINGS

Figure 4:
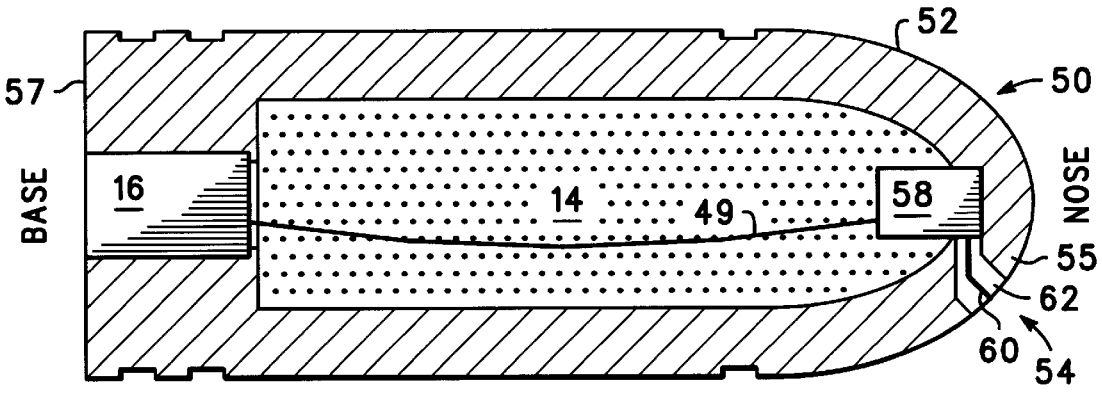
FIG. 4 is a view analogous to FIG. 1 but of a first embodiment of the present invention.

FIG. 4 shows a side cross-sectional and partial cutaway view of weapon projectile 50 according to a first embodiment of the present invention. Projectile 50 has casing 52, explosive charge 14 and optional base fuze 16 analogous to corresponding elements 12, 14, 16 of FIG. 1. There is further provided target material sensing fuze 54 mounted, in this implementation of the present invention, near but not at nose 55 of casing 52. Target material sensing fuze 54 comprises sensor or antenna 56 and sensing and detonating electronic module 58. Optional wire 49 couples module 58 and conventional inertial fuze 16 where coordination between the two is required.

Figure 5:
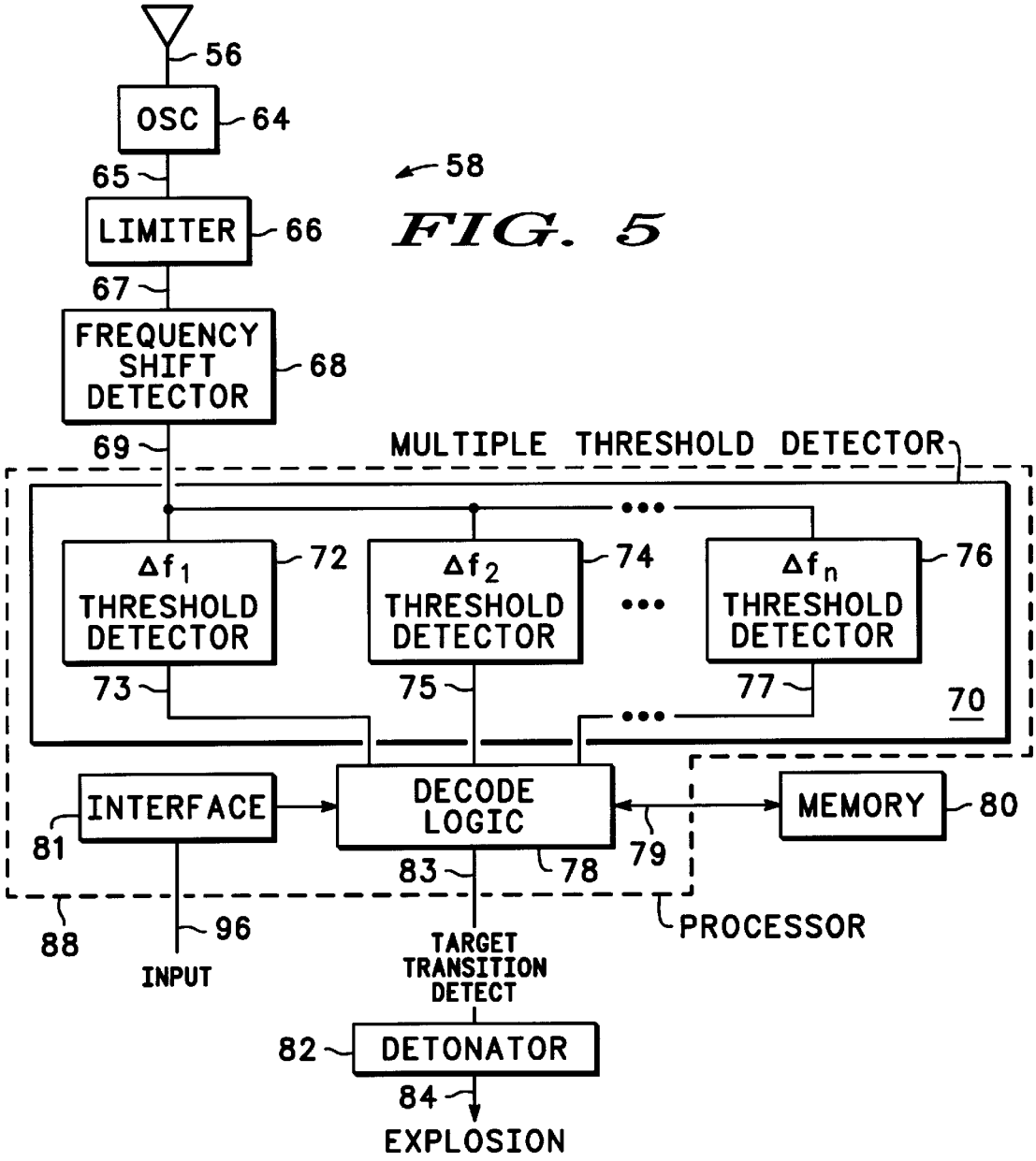
FIG. 5 is a simplified schematic block diagram of an electronic circuit forming a portion of the present invention, according to a first embodiment.
Figure 6:
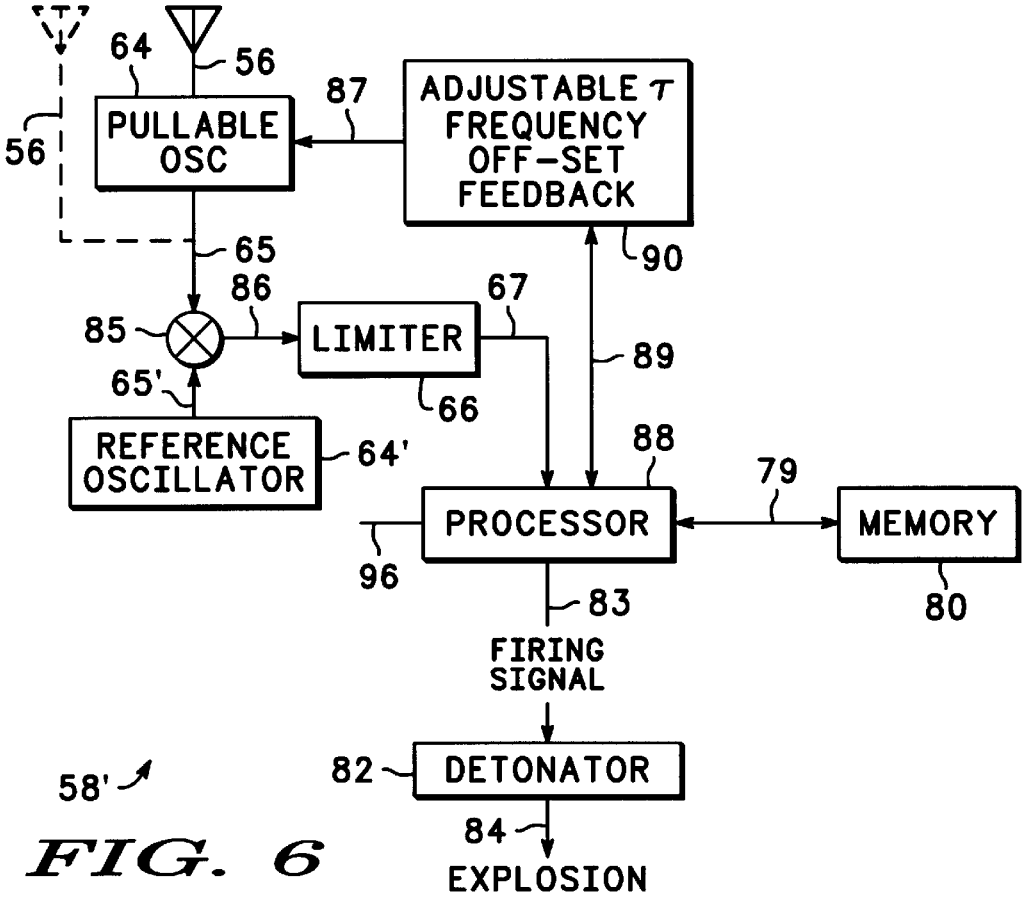
FIG. 6 is a further simplified schematic block diagram according to a still further embodiment of the present invention.

FIG. 5 is a simplified schematic block diagram of sensing and detonating electronic module 58 coupled to sensor or antenna 56, according to a first embodiment of the present invention. FIG. 6 is a simplified schematic block diagram of sensing and detonating electronic module 58' coupled to antenna 56 according to a further embodiment of the present invention. The operation of improved projectile 50 is best understood by considering FIGS. 4–6 together.

Referring now to FIG. 5, antenna 56 is coupled to oscillator 64. Oscillator 64 is preferably of a type whose frequency of oscillation is sensitive to variations in the loading of antenna 56 provided by variations in the material into which antenna 56 is radiating, i.e., a "pullable" or "compliant" oscillator. As those of skill in the art will understand based on the description herein, varying, for example, the dielectric constant and conductivity of the material into which sensor or antenna 56 is radiating causes the complex impedance of antenna 56 presented to oscillator 64 to vary. When antenna 56 is a part of the frequency determining elements making up oscillator 64, then changes in the complex impedance presented by antenna 56 will cause the output frequency of oscillator 64 to vary.

Output 65 of oscillator 64 is coupled to limiter 66 whose function is to remove any amplitude variation from the signal being provided by oscillator 64. Output 67 of limiter 66 is coupled to frequency shift detector 68 which detects the changes in the frequency of oscillator 64 in response to changes in the material into which antenna 56 is radiating. Output 69 of frequency shift detector 68 is coupled to multiple threshold detector 70. By way of example, multiple threshold detector 70 is shown as having first threshold detector 72, second threshold detector 74, and nth threshold detector 76. First threshold detector 72 is set to detect a frequency shift $\Delta F_1$, second threshold detector 74 is set to detect a frequency shift $\Delta F_2$, and nth threshold detector 76 is set to detect a frequency shift $\Delta F_n$, where n is a number determined by the user depending upon the complexity of the signal analysis that is desired. Threshold detectors 72, 74, 76 determine when the frequency shift produced by frequency shift detector 69 corresponds to predetermined levels of $\Delta F_1$, $\Delta F_2$, . . . $\Delta F_n$. Outputs 73, 75, 77 from threshold detector 72, 74, 76 are fed to decode logic 78. Decode logic 78 is desirably coupled by a signal line 79 to memory 80 in which has been stored the target profile on which the fuze is desired to detonate. Decode logic provides "Target Transition Detect" signal 83, to detonator 82 which in turn produces initial explosive flame 84 whose purpose is to detonate main powder charge 14. Multiple threshold Detector 70, decode logic 78 and interface comprise intelligent processor 88 which uses target profile information received, for example, via input 96 and interface 81 and stored in memory 80 to determine the optimum time for detonating fuze 54.

FIG. 6 shows a simplified schematic block diagram of sensing and detonating module 58' according to a further embodiment of the present invention. Antenna 56 is coupled to pullable oscillator 64 in either of the two manners shown. Output signal 65 from pullable oscillator 64 is in turn coupled to mixer 85. Stable reference oscillator 64' having output 65' is also coupled to mixer 85. Output 86 from mixer 85 is coupled to limiter 66 which removes amplitude modulation effects from the output of mixer 85. Output 67 of limiter 66 is fed to processor 88 which combines the functions of multiple threshold detector 70, decode logic 78 and interface 81 of FIG. 5. Processor 88 provides firing signal 83 to detonator 82 which in turn generates explosion 84. Output 89 from processor 88 is fed to adjustable time constant (t) frequency offset feedback circuit 90 whose output 87 is fed back to pullable oscillator 64. The operation of adjustable time constant (t) frequency offset feedback circuit 90 is under the control of processor 88 which is coupled to memory 80 via line 79, wherein mission and target profile parameters are be stored. Processor 88 has external port 96 via which information can be stored in memory 80 so as to control the overall operation of target material detecting fuze 54.

The purpose of adjustable time constant frequency offset feedback circuit 90 is to adjust the frequency of pullable oscillator 64 as compared to reference oscillator 64' so that output 67 from limiter 66 via mixer 85 has a predetermined offset frequency under the control of processor 88. This allows the sensitivity of the entire fuze electronic system to be substantially increased. By setting the frequencies of pullable oscillator 64 and reference oscillator 64' to be relatively close together, very small percentage changes in the frequency of pullable oscillator 64 can be readily detected.

A further advantage of the arrangement of FIG. 6 is that it allows the fuze system to be dynamically recalibrated or normalized during flight and even during penetration through various target regions. For example, (referring to FIG. 2) as projectile 50 passes through the air prior to striking wall 18, circuit 90 adjusts oscillator 64 so that output 67 of limiter 66 has a preprogrammed offset frequency stored in memory 80. When projectile 50 strikes wall 18, there is a very sudden change in the frequency of pullable oscillator 64 as the material into which antenna 56 radiates changes from, for example, air to concrete. This change in frequency occurs in a time period which is a small fraction of a millisecond. For a projectile having a velocity of 1,000 feet per second and with a wall thickness 20 of one foot, projectile 50 remains within wall 18 for approximately one millisecond. By programming in various time constants for circuit 90, the frequency offset produced by projectile 50 striking wall 18 can be removed so that signal 67 returns to the predetermined offset prior to projectile 50 emerging from wall 18. Then, when projectile 50 emerges from wall 18, there is once again a rapid transition and percentage frequency change of pullable oscillator 64. This is the desirable result, since it makes it easy to quickly and precisely determine the point and time at which projectile 50 has begun to emerge from wall 18. Since the location of antenna 56 with respect to projectile 50 is known, the emergence of antenna 56 from wall 18 allows one to determine when the entire shell will have emerged. It is important that the time constant of feedback circuit 90 be long compared to the time constant of the transitions desired to be detected.

Because sensing and detonating electronic module 58, 58' operates under the supervision of processor 88, very complex target mission profiles can be programmed into sensing and detonating electronic module 58, 58'. For example, where the target is expected to be a bunker, pill box, or fuel storage tank, which may be protected by multiple concrete and/or steel walls separated by soil or air-filled intermediate spaces, sensing and detonating electronic module 58 can be programmed to count material transitions and detonate in any selected interior space or location. In prior art fuzes, it has generally been possible to reliably detect transitions from low density spaces (e.g. air or loose soil) into high density spaces (e.g. concrete, steel, etc.), but extremely difficult to detect transitions from high density to low density materials with any precision. A significant advantage of the present invention is that it provides a simple, reliable, and accurate means for detecting both low-high and high-low density material transitions. This is because the sensing action is not dependent upon changes in the inertial forces to which the projectile is subjected, but rather changes in the electromagnetic properties of the materials through which the projectile is passing. Accordingly, the present invention provides a significantly improved detection system.

It will be noted that the action of the sensing and detecting module of the present invention is different than that of a conventional proximity fuze. A conventional proximity fuze provides an indication as to when the projectile flying through the air is approaching an object of substantially different electrical properties (e.g., metal or reinforced concrete) and the fuze can be set to explode in the air a predetermined distance from such object. While the combination of sensor antenna 56 and sensing and detonating electronic module logic 58, 58' are capable of detecting proximity to objects, that is in general not their most important function. An important requirement of the apparatus 56, 58, 58' of the present invention is that it survive penetration through at least the first layer of the target so as to sense the internal structure of the target material so that the explosion can be timed to occur at predetermined depths or predetermined layers within the target. Conventional proximity fuzes are unable to do this and are generally destroyed by target impact.

Figure 7:
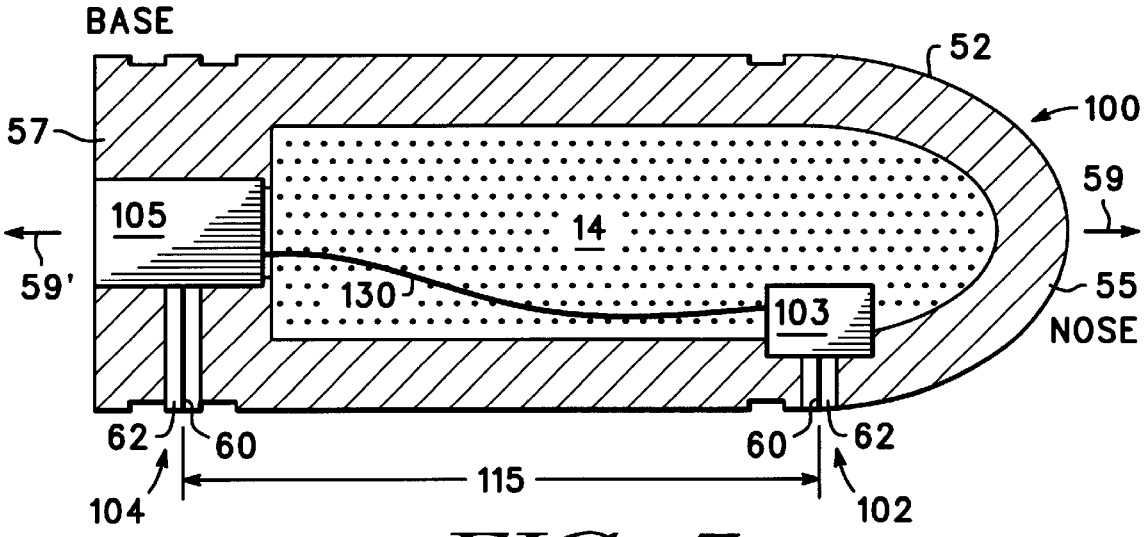
FIG. 7 is a view analogous to FIG. 4 but according to a further embodiment of the present invention.

FIG. 7 is a representation analogous to that shown in FIG. 4 of projectile 100 according to a further embodiment of the present invention. Projectile 100 contains two sensor antennas 102, 104 and associated sensing and detonating electronic modules 103, 105, desirably coupled by lead 130. Modules 103, 105 are analogous to either of module 58, 58'. Sensing antenna 102 is located in the general proximity of nose 55, but, preferably, not oriented in the direction of flight 59, and sensor antenna 104 is located preferably in the vicinity of base 57 and, again, generally not oriented in the anti-flight direction 59'. As shown in FIG. 7, it is preferred that antennas 102, 104 radiate in a direction generally at right angles to flight path 59, since their function is to detect the nature of the material through which projectile 100 is passing. Each of antennas 102, 104 and their associated sensing and detonating electronic modules 103, 105 include those features and functions described in connections with sensing antenna 56 and sensing and detonating electronic modules 58 or 58'. By means of coupling wire 130, the information being independently gathered by 102, 103 and 104, 105 can be correlated.

In projectiles 50, 100, sensor antennas 56, 102, 104 comprise, most conveniently, thin metallic rod or wire member 60 embedded within a dielectric 62 and radiating through the sidewall of casing 52. Wire 60 can be straight or coiled and antenna sensor 56, 102, 104 functions generally as an end fire antenna. It is not necessary that wire 60 protrude from dielectric 62 at the exterior of casing 52.

Figure 8:
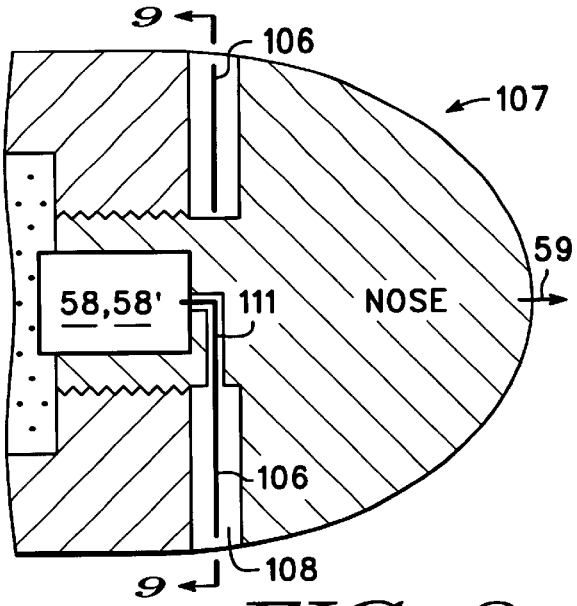
FIG. 8 is a side cross-sectional and partial cutaway view, according to a still further embodiment of the present invention, of a nose portion of a projectile.
Figure 9:
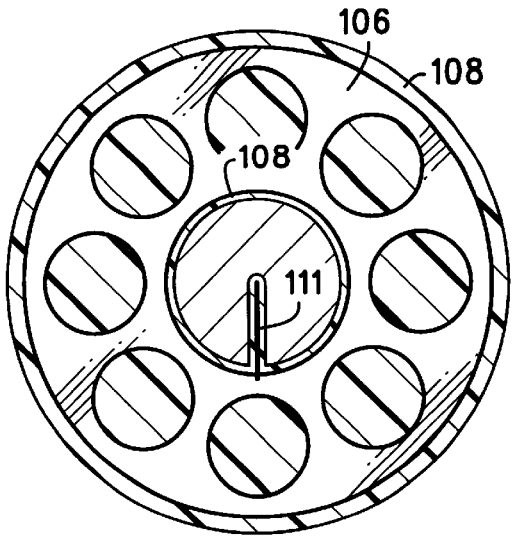
FIG. 9 is a cross-sectional view at the location indicated in FIG. 8.

FIG. 8 shows in partial cross-sectional and cutaway view, portion 107 of projectile 100 according to a further embodiment of the present invention, and FIG. 9 shows a cross-sectional and partial cutaway view at right angles to the view of FIG. 8 at the location indicated on FIG. 8. In the embodiment illustrated in FIGS. 8–9, antenna 106 is in the form of a disk embedded in dielectric 108 and coupled to electronic module 58, 58' by wire or lead 111. Holes are desirable provided in disk 106 to lighten it and lock it firmly in place within dielectric 108. Antenna 106 radiates generally in an approximately disk-shaped pattern at right angles to projectile line of flight 59.

Figure 10:
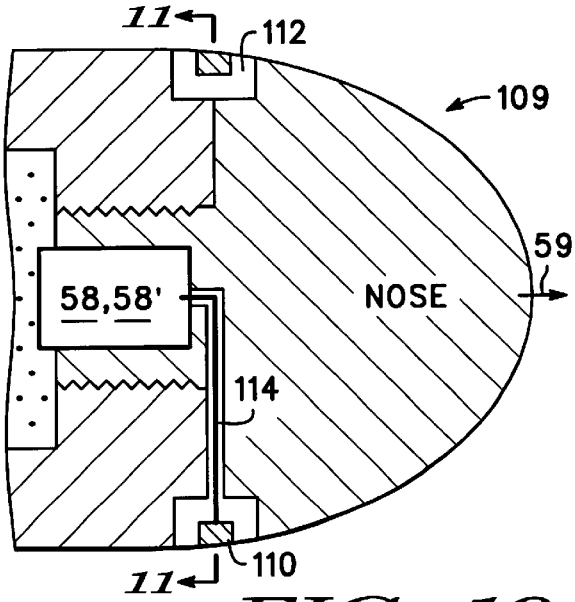
FIG. 10 is a view similar to FIG. 8 but showing a still further embodiment of the present invention and FIG. 11 is a view similar to FIG. 9 at the location shown in FIG. 10.
Figure 11:
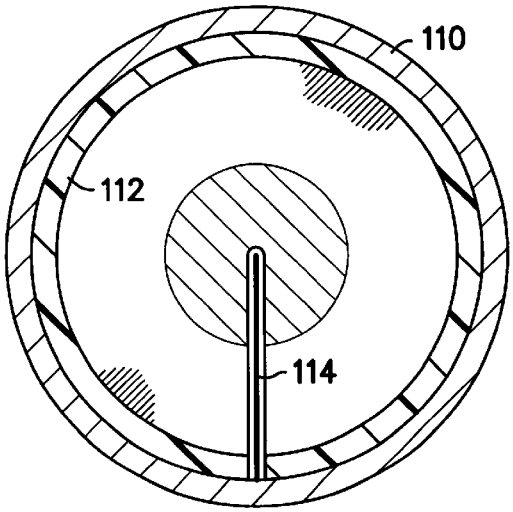

FIGS. 10–11 illustrate a still further embodiment of the present invention showing nose portion 109 and corresponding cross section similar to that in FIGS. 8–9, wherein projectile 109 has antenna 110 in the shape of an comparative thin annular ring embedded in dielectric 112 and coupled to control and detonating electronic module 58, 58' by wire or lead 114. The arrangement of FIGS. 10–11 provides a radiation pattern generally similar to that in FIGS. 8–9 but with different side lobes in the direction of travel 59 of the projectile.

Figure 12:
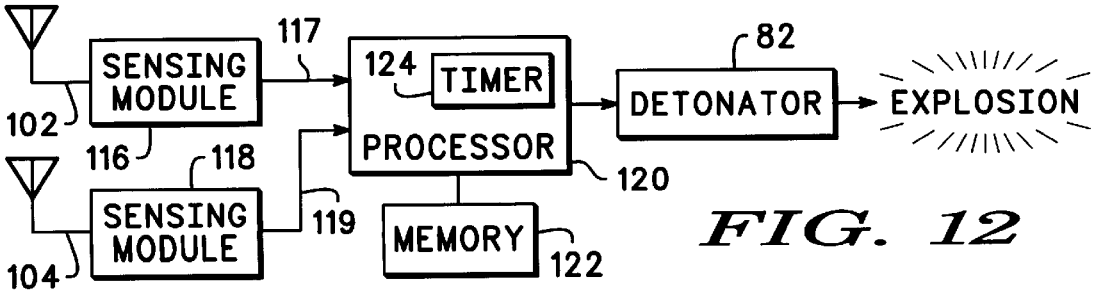
FIG. 12 is a simplified schematic block diagram of an additional embodiment of the present invention.

FIG. 12 is a simplified schematic block diagram indicating the arrangement of the sensing and detonating electronic modules 116, 118 analogous to modules 103, 105 of FIG. 7. Electronic modules 116, 118 can be independent electronic modules analogous to modules 58, 58', 103, 105, or can be coupled by wire 130 so that they act in concert.

In the arrangement illustrated in FIG. 12, they share processor 120. Antenna 102 is coupled to sensing module 116 and antenna 104 is coupled to sensing module 118 which perform functions analogous to those described in connection with sensing and detonating modules 58, 58' except that processor 120 and memory 122 are common to both sensor modules 116, 118. The output from processor 120 is fed to detonator 82 in the same manner as has been previously described. The purpose of sensing modules 116, 118 is to provide output signals (e.g., frequency shifts) indicating that there has been a transition of material properties (e.g., from one density to a material of another density) as projectile 100 passes through various target layers. Output 117 from sensing module 116 can indicate that antenna 102 has detected a high-low density transition while output 119 from sensing module 118 indicates that sensor 104 has not yet arrived at the same transition. There is provided in connection with processor 120 memory 122 and timer 124. As projectile 100 passes through various target layers, sensors 102, 104 will indicate the same transitions at different times. By means of timer 124, and the known separation 115 of sensor antennas 102, 104 (see FIG. 7), processor 120 periodically determines the instantaneous velocity of projectile 100 as it penetrates through various target layers. This is accomplished by determining the time interval required for sensors 102 and 104 to pass through the same transition. This gives a direct measure of the velocity of projectile 100 as it passes through various target layers and is extremely useful in determining the correct detonation point for the projectile. This is a substantial improvement over prior art systems which were unable to reliably provide a measure of the velocity of the projectile as it decelerated in passing through various target layers. In the prior art, time delay associated with a given number of penetrations or a given distance of penetration were extremely inaccurate and, thereby decreased the effectiveness of the explosion provided by the projectile. Thus, the ability of the present invention to provide continuing velocity information as the projectile decelerates is extremely important for improving the effect of the munitions.

Referring again to FIG. 4, there is another manner in which the velocity of the projectile can be determined even when only a single sensor antenna is used. As projectile 50 approaches a transition, but before it strikes the transition region, there will be a Doppler shift in the radiated signals back scattered from the target. By including within the sensing and detection electronic module 58 (e.g., within processor 88), a Doppler shift detector, a measure of the velocity with which projectile 50 is approaching an abrupt transition in density can readily be determined. Thus, even in the case of a projectile employing only one sensor 56, information concerning the rate of deceleration of the projectile can be obtained using the present system.

EXAMPLE

A simulated antenna sensor and supporting electronic module was prepared in the form of wire embedded in a plastic nose cone. The nose cone was approximately 25–30 mm in diameter and of about equal length and was mounted on a metal base supported by a plastic wand. The embedded antenna wire was driven by a compliant (pullable) oscillator operating at about 5.419 GHz. The nose cone plastic was "GLASTIC-1412" manufactured by the Plastic Corporation of Canton, Ohio. The wire forming the antenna was mounted axially and enclosed within the plastic nose cone, i.e., it did not protrude through the nose cone. A separate receiving pick-up antenna coupled to a spectrum analyzer was placed nearby to detect the output frequency of the pullable oscillator driving the sensor antenna as various materials were then brought into contact to the plastic dome or vice versa, as follows:

| Target Material | Frequency Change | Conditions |
|---|---|---|
| Metal | −23 MHz | Touching |
| Wood | −2 to 3 MHz | Touching |
| Brick | −10 MHz | Touching |
| Damp Soil | −24 MHz | Immersed |

For metal, wood and brick, the changes reported are those observed when the end of the probe was brought into contact with the stated material. In the case of the soil, the reported frequency change is with the probe immersed in the soil. A much smaller change was observed when the probe was merely in contact with the soil and not immersed. Thus, the frequency shifts associated with the different materials were readily distinguishable.

It will be appreciated based on the explanation herein that the present invention also serves conveniently as a probe to detect material layer transitions in any kind of a target, e.g., in a well bore hole or other subterranean probe. The method of doing this comprises, for example, providing a probe casing, providing an antenna radiating through the probe casing, providing a pullable oscillator driving the antenna and susceptible to changes in the antenna environment, providing a frequency measuring circuit coupled to the oscillator and using the circuit to measure changes in frequency of the pullable oscillator in response to changes in the material adjacent the probe into which the antenna is radiating as it passes from layer to layer. In a preferred embodiment, the method includes, adjusting a frequency of the pullable oscillator to a predetermined off-set value while the antenna is in a first target layer and prior to entering a second target layer. It is also desirable to provide a second antenna, pullable oscillator and frequency measuring circuit wherein the second antenna is spaced apart from the first antenna in a direction of travel of the probe, and then compare outputs from the first and second frequency measuring circuits to detect material transitions adjacent the casing. In this manner, changes in the properties of buried layers can be detected.

Having thus described the system, persons of skill in the art will appreciate that the present invention provides an improved means and method for probing layers of varying composition and for detonation of weapon projectiles, especially in connection with multi-layer targets where the ability to determine the number and character of target layers through which the probe or projectile has passed is extremely important. In the case of explosive projectiles, this allows the maximum damage to be obtained from the explosive charge within the projectile.

What is claimed is:

1. A penetrating projectile, comprising:

an exterior casing;

a detonator within the exterior casing for detonating the projectile;

a first antenna radiating a signal from an exterior wall of the exterior casing, wherein the first antenna is sufficiently rugged to at least survive penetration through a first target layer;

a first electronic detection circuit coupled to the first antenna and supported by the exterior casing for detecting changes in the signal caused by changes in target material adjacent to the first antenna to indicate target layer transitions during target penetration by the projectile and the first electronic detection circuit comprises a pullable oscillator coupled to the first antenna and a frequency shift detector coupled to the pullable oscillator to detect changes in frequency of the pullable oscillator in response to different target materials being presented to the first antenna.

2. The projectile of claim 1 further comprising a second antenna and a second electronic detection circuit, the second antenna being spaced apart from the first antenna along a longitudinal dimension of the projectile.

3. The projectile of claim 2 wherein either or both the first electronic detection circuit or the second electronic detection circuit comprises a processor, wherein the processor computes projectile velocity based on at least one time delay between target layer transitions sequentially detected by the first antenna and the second antenna.

4. The projectile of claim 2, wherein the second electronic detection circuit comprises a pullable oscillator coupled to the second antenna and a frequency shift detector coupled to the pullable oscillator to detect changes in frequency of the pullable oscillator in response to different target materials being presented to the second antenna.

5. The projectile of claim 4, further comprising a reference oscillator and a mixer for combining an output of the reference oscillator and an output of the pullable oscillator to provide a predetermined offset frequency whose average magnitude is determined by an adjustable time constant frequency offset feedback circuit coupled between an output of the mixer and the pullable oscillator.

6. The projectile of claim 5, wherein the adjustable time constant frequency offset feedback circuit has a first time constant and the frequency shift detector has a second time constant less than the first time constant.

7. The projectile of claim 1 further comprising an accelerometer whose output is coupled to the first electronic detection circuit for indicating inertial forces to which the projectile is selected.

8. The projectile of claim 1, further comprising a reference oscillator and a mixer for combining an output of the reference oscillator and an output of the pullable oscillator to provide a predetermined offset frequency whose average magnitude is determined by an adjustable time constant frequency offset feedback circuit coupled between an output of the mixer and the pullable oscillator.

9. The projectile of claim 8, wherein the adjustable time constant frequency offset feedback circuit has a first time constant and the frequency shift detector has a second time constant less than the first time constant.

* * * * *

UNITED STATES PATENT AND TRADEMARK OFFICE

CERTIFICATE OF CORRECTION

PATENT NO. : 6,378,435 B2
DATED : April 30, 2002
INVENTOR(S) : Bai et al.

It is certified that error appears in the above-identified patent and that said Letters Patent is hereby corrected as shown below:

Column 4,
Lines 10 and 12, delete "(t)" and insert -- (τ) --

Signed and Sealed this

Fourth Day of January, 2005

JON W. DUDAS
*Director of the United States Patent and Trademark Office*